US005346596A

United States Patent [19]

Borrione et al.

[11] Patent Number: 5,346,596

[45] Date of Patent: Sep. 13, 1994

[54] METHOD FOR BYPASSING A MONOPOLAR ELECTROLYZER IN SERIES

[75] Inventors: Pierluigi A. V. Borrione, Milan, Italy; Gregory J. E. Morris, Midland, Mich.; Maurizio Marzupio, Capriate San Gervasio, Italy; Michel Pillet, Grasse, France

[73] Assignee: De Nora Permelec S.p.A., Italy

[21] Appl. No.: 24,194

[22] Filed: Feb. 26, 1993

Related U.S. Application Data

[63] Continuation-in-part of Ser. No. 910,246, Jul. 9, 1992, Pat. No. 5,207,883, which is a continuation-in-part of Ser. No. 751,340, Aug. 29, 1991, abandoned.

[30] Foreign Application Priority Data

Dec. 21, 1990 [IT] Italy ..... 22510
Dec. 20, 1991 [EP] European Pat. Off. ..... 91122025.9

[51] Int. Cl.[5] ..... C25B 15/02; C25B 9/04
[52] U.S. Cl. ..... 204/1.11; 204/228
[58] Field of Search ..... 204/228, 267, 253, 279, 204/1.11, 254–258, 268–270, 271

[56] References Cited

U.S. PATENT DOCUMENTS

| | | | |
|---|---|---|---|
| 2,649,510 | 8/1953 | Michaelis | 204/228 X |
| 3,930,978 | 1/1976 | Strewe et al. | 204/228 |
| 4,078,984 | 3/1978 | Strewe | 204/228 |
| 4,227,987 | 10/1980 | Kircher et al. | 204/228 |
| 4,251,334 | 2/1981 | Kircher | 204/228 X |
| 4,390,763 | 6/1983 | Hruda | 204/228 X |
| 4,537,662 | 8/1985 | Hruda | 204/1.11 |
| 4,589,966 | 5/1986 | Ford | 204/228 |

*Primary Examiner*—Donald R. Valentine
*Attorney, Agent, or Firm*—Bierman and Muserlian

[57] ABSTRACT

A method for by-passing a monopolar electrolyzer out of a plurality of monopolar electrolyzers connected in series to an electrical power source, which electrolyzers consist of individual electrolysis cells each having anodic and cathodic contact points, using a jumper switch means comprising an internal circuitry and multiplicity of extension arms for connection to the electrolyzers immediately preceding and following the electrolyzer to be by-passed while preventing a shift in current through individual cells of the electrolyzers adjacent to the electrolyzer to be by-passed and to prevent damage to the electrolyzers by avoiding reversed current flow.

4 Claims, 7 Drawing Sheets

METHOD FOR BYPASSING A MONOPOLAR ELECTROLYZER IN SERIES

PRIOR APPLICATION

This application is a continuation-in-part Application of U.S. patent application Ser. No. 910,246 filed Jul. 9, 1992, now U.S. patent application No. 5,207,883 which is a continuation-in-part application of U.S. patent applicaton Ser. No. 751,340, filed Aug. 29, 1991, now abandoned.

STATE OF THE ART

Electrolyzers such as membrane electrolyzers of the chor-alkali filter press type for the electrolysis of sodium chloride are susceptible to damage when disconnecting one electrolyzer from a series of electrolyzers in a circuit. One type of damage affects the electrocatalytically active coating on the cathode surface of the electrolyzer to be bypassed and it is caused by reverse current flow. Damage also occurs if excessive current passes through individual cells of the electrolyzers adjacent to the electrolyzer to be bypassed as a consequence of shifting the current flow to those cells closest to the bypass switch connection.

A number of solutions to these problems have been proposed such as in U.S. Pat. No. 4,561,949 and U.S. Pat. No. 4,589,966. Both describe short circuit devices that permit partial or total flow of electric current to be bypassed around an electrolyzer and both provide a method to redirect the current around the electrolyzer to be disconnected without creating a reverse current flow to the by-passed electrolyzer. However, neither patent provides a means for uniform flow of current from a plurality of cells of a preceding adjacent electrolyzer to a plurality of cells in a following adjacent electrolyzer.

OBJECTS OF THE INVENTION

It is an object of the invention to provide a method for shutting down an electrolyzer in a plurality of electrolyzers connected in series to an electrical power source, especially monopolar electrolytic electrolyzers for the electrolysis of aqueous solutions, which apparatus is capable of preventing a shift in current through individual cells of the electrolyzers adjacent to the electrolyzer to be bypassed and to prevent damage to electrolyzers by avoiding reverse current flow.

This and other objects and advantages of the invention will become obvious from the following detailed description.

THE INVENTION

The novel method of the invention a method for by-passing a monopolar electrolyzer out of a plurality of monopolar electrolyzers connected in series to an electrical power source, which electrolyzers consist of individual electrolysis cells each having anodic and cathodic contact points, by means of a jumper switch means comprising an internal circuitry and a multiplicity of extension arms for connection to the electrolyzers immediately preceding and following the electrolyzer to be by-passed, characterized in that said jumper switch means is positioned on a mobile cart (33) provided with mechanical devices suitable for permitting withdrawal of an electrolyzer out of the plurality of electrolyzers connected in series;

said cart is brought in proximity of the electrolyzer to be by-passed;

said jumper switch means is moved above the plurality of electrolyzers and supported by said multiplicity of extension arms fixed onto the contact points of the two electrolyzers immediately preceding and immediately following the electrolyzer to be by-passed, said multiplicity of extension arms comprising first extension arms connected to the anodic contact point of each individual cell of the electrolyzer immediately preceding the electrolyzer to be by-passed and second extension arms connected to the cathodic contact point of each individual cell of the electrolyzer to be by-passed, said first and second extension arms being joined to said internal circuitry to provide by-passing of the electrolyzer without a shift of electrical current in the adjacent cells of the electrolyzers immediately preceding and immediately following the electrolyzer to be by-passed;

the by-passed electrolyzer is transferred onto said cart and moved to a maintenance area.

REFERRING NOW TO THE FIGURES

FIGS. 1 and 2 illustrate a conventional jumper switch means of the prior art and the current flow therethrough.

FIGS. 3, 4 and 5 schematically illustrate one embodiment of the invention consisting of an overhead jumper switch means in a top, front (section X—X) and side view, respectively.

Figure 8:
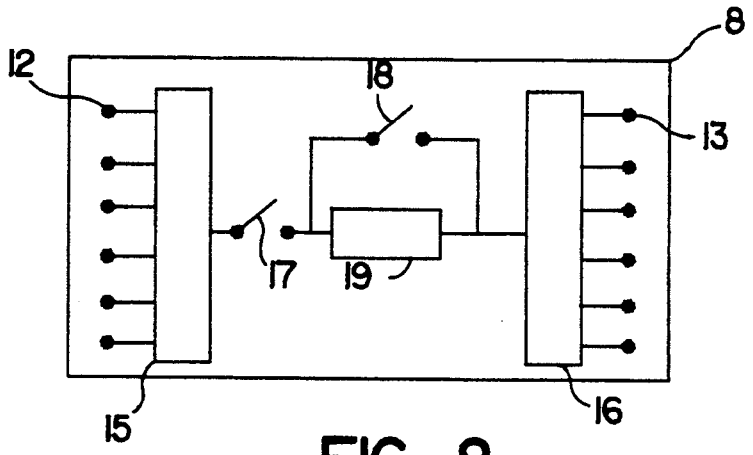
Figure 9:
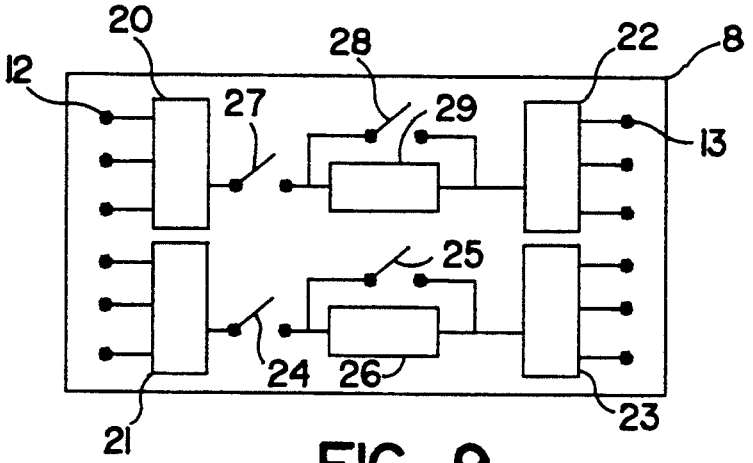
Figure 10:
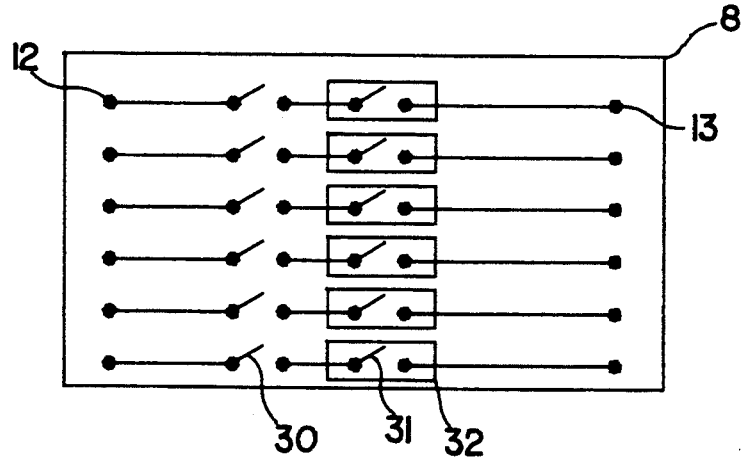

FIGS. 8, 9 and 10 schematically illustrate three of the several alternatives for the internal electrical circuitry of the jumper switch means to avoid a shift of electrical current in the adjacent cells of the electrolyzers immediately preceding and following the electrolyzer to be bypassed.

FIG. 10 illustrates the jumper switch means mounted on a mobile cart just below moving the same into place to by pass an electrolyzer.

Figure 11:
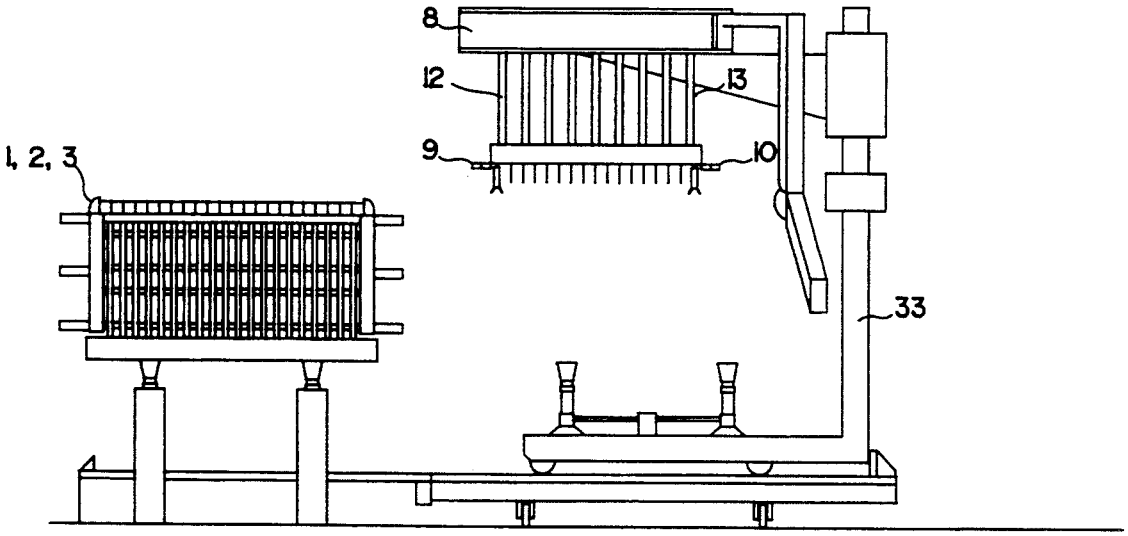
Figure 12:
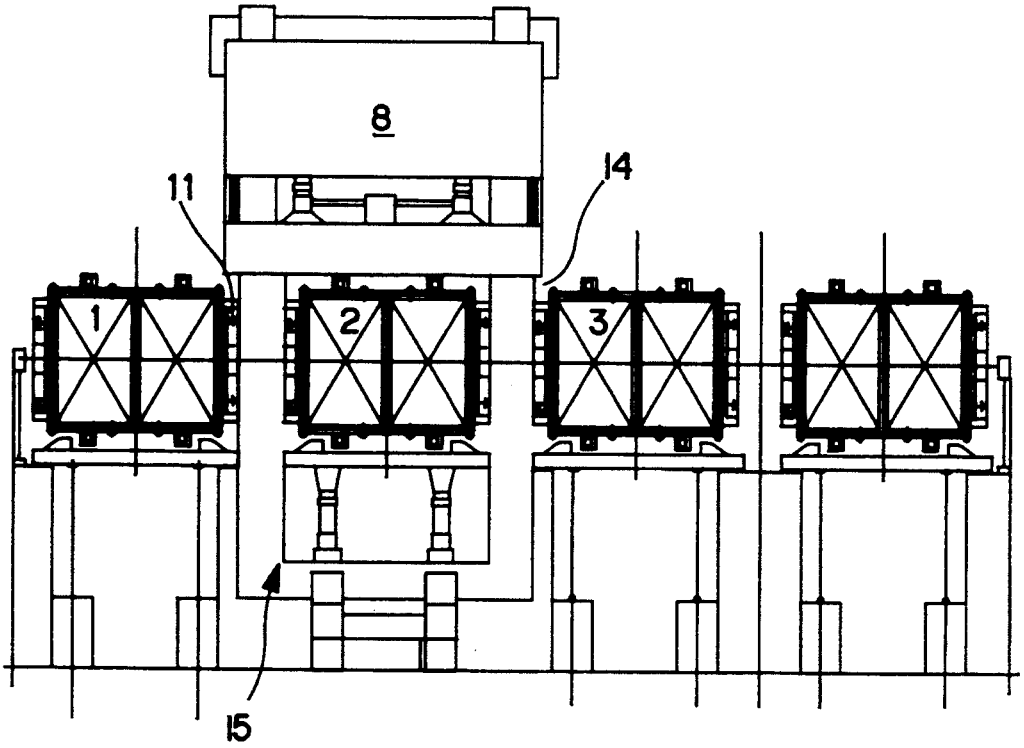

FIGS. 11 and 12 illustrate the jumper switch means in position before the mobile cart removes the electrolyzer from the line of electrolyzers.

Figure 1:
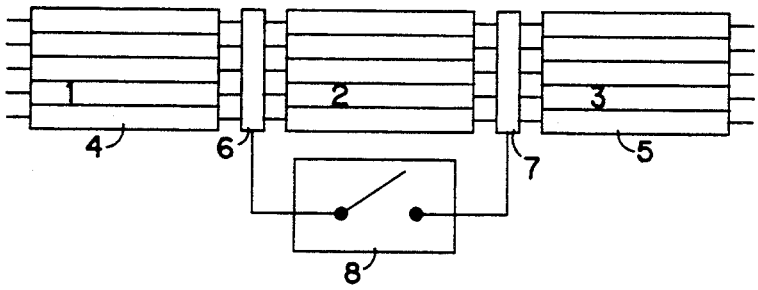
FIG. 1 PRIOR ART
Figure 2:
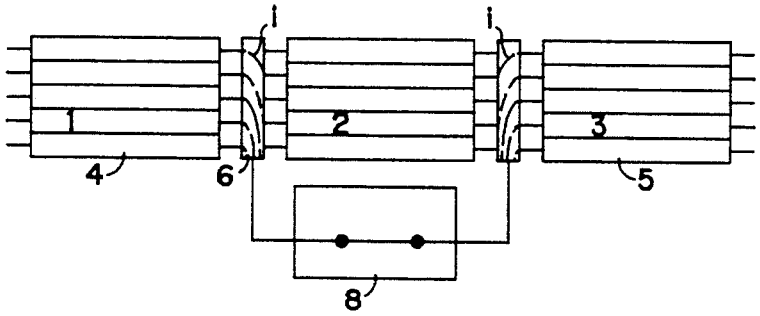
FIG. 2 PRIOR ART

In FIGS. 1 and 2, the conventional jumper switch means is intended to bypass electrolyzer 2 by connecting the jumper switch means connecting electrolyzers 1 and 3 to bus bars 6 and 7. This apparatus does not prevent the shift of electric current flow (i) towards the apparatus contact points at bus bars 6 and 7. FIG. 2 illustrates the current flow in electrolyzers 1 and 3 just before and after electrolyzer 2 once the switch has been closed. The dashed current lines (i) indicate the increase of current flow of cells 4 and 5 closest to the switch contact points, as a consequence of the shorter current path in bus bars 6 and 7.

Figure 3:
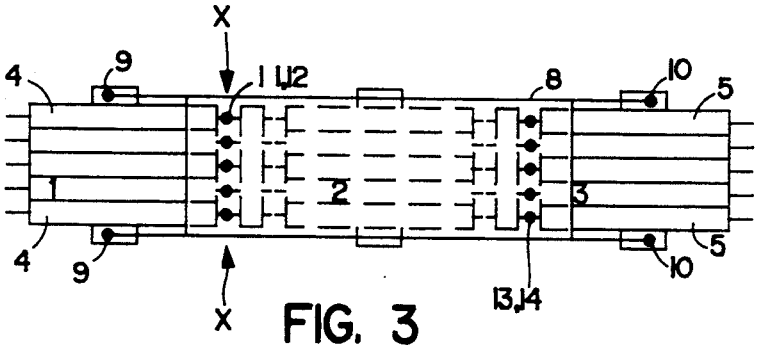
Figure 4:
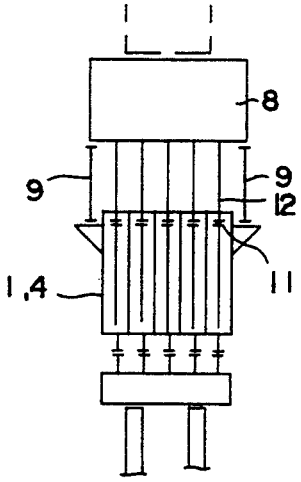
Figure 5:
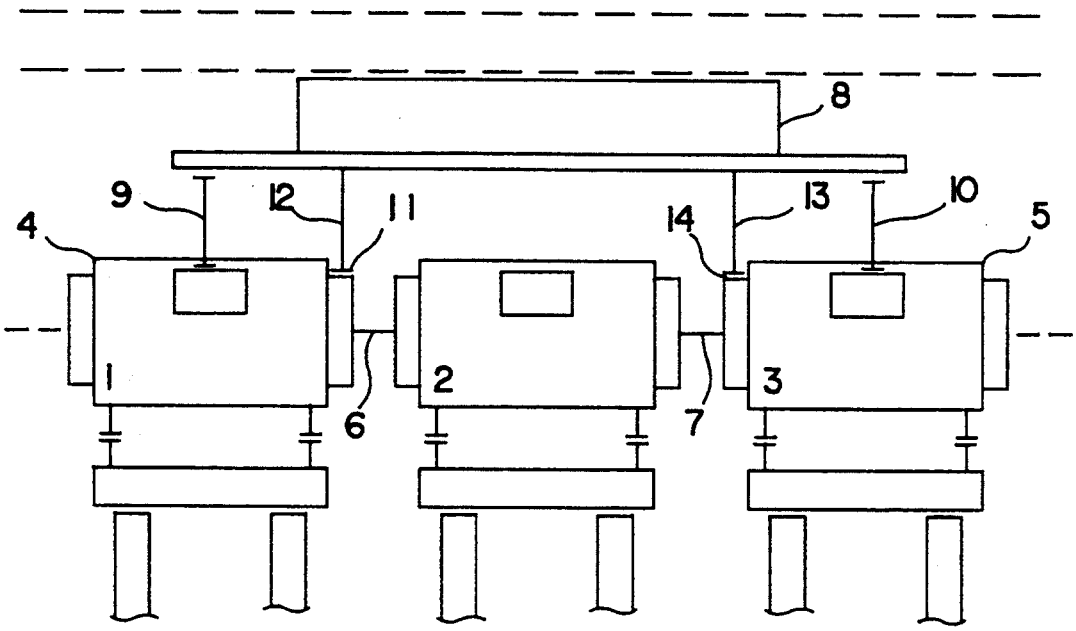

FIGS. 3, 4 and 5 schematically describe the top, front section X'X) and side view of a series of monopolar electrolyzers 1, 2 and 3, each containing a plurality of adjacently positioned electrolytic cells 4 and 5 and an overhead jumper switch means 8 directed to bypass electrolyzer 2. The jumper switch means 8 is supported by supporting means 9 and 10 fixed to electrolyzers 1 and 3 and is connected to the anodic contact points 11 of each monopolar cell 4 of the immediately preceding electrolyzer 1 by a mutliplicity of extension arms 12. The jumper switch means 8 is also connected to tile cathodic contact points 14 of each monopolar cell 5 of the immediately following electrolyzer 3 by a multiplicity of extension arms 13. In order to obtain a low-resistance connection between each pair of extension arms and anodic or cathodic contact points, the extension arms, which may be either rigid or flexible, may be provided in their lower ends with spring-located pincers. These last ones are forced to pinch the strip-shaped anodic or cathodic contact points by the weight of the jumper switch means 8 itself. The jumper switch means 8 is also connected to a traveling crane, which allows for positioning the jumper switch means just above the electrolyzer to be bypassed in a series of electrolyzers of a cell room of an industrial electrolysis plant.

Figure 6:
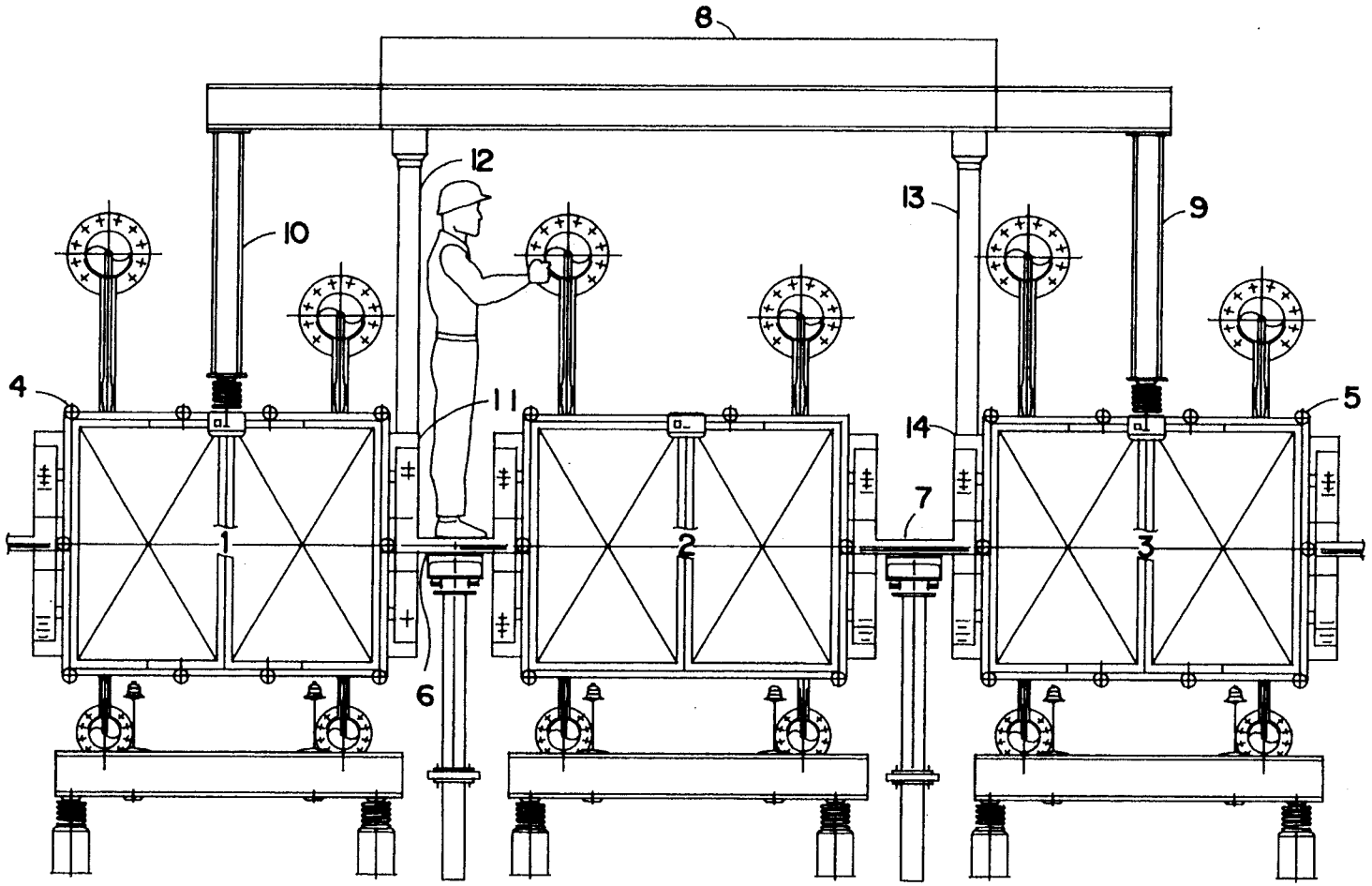
FIG. 6 is a pictorial view of the embodiment of FIGS. 3, 4 and 5.

FIG. 6 is a pictorial view of the embodiment schematized in FIGS. 3, 4 and 5.

Figure 7:
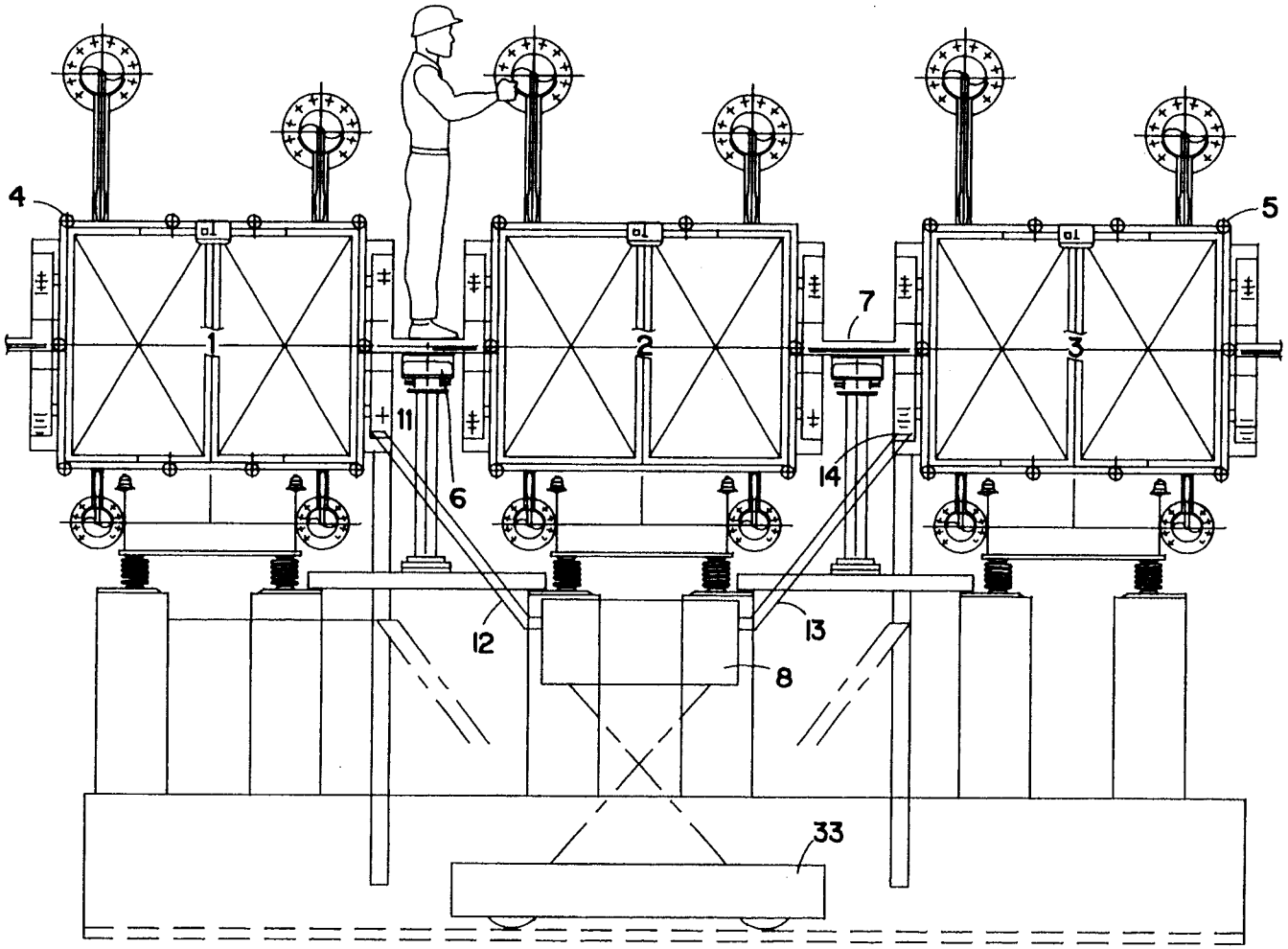
FIG. 7 is a pictorial view of a second embodiment of the invention of a jumper switch means located beneath the electrolyzers.

FIG. 7 is an analogous pictorial view of a second embodiment of the invention wherein the jumper switch means 8 is positioned beneath the electrolyzers and is supported by a cart 33 traveling along rails located just below each row of electrolyzers. The remaining components are unchanged as well as the relevant numerals.

The electric current is directed from the monopolar cells 4 of the immediately preceding electrolyzer 1 through-the contact points 11 and the multiplicity of extension arms 12 to the jumper switch means 8. The electric current then flows through resistor means in the jumper switch means 8 to control the flow of electric current to the multiplicity of extension arm 13 and to the contact points 14 of the monopolar cells 5 of the immediately following electrolyzer 3. The current is withdrawn progressively in equal portions from the monopolar cells 4 and is fed in equal portion to the monopolar cells 5. In such a way that the problems associated with shifting of the current previously discussed are completely overcome.

FIGS. 8, 9 and 10 show three possible arrangements for the internal circuitry of the jumper switch means 8 of the invention.

More particularly, FIG. 8 shows that extension arms 12 and 13 can be connected to bus bars 15 and 16, the cross section of which is by far larger than the bus bars connecting the electrolyzers (numerals 6 and 7 in the preceding figures). This generously sized cross section or area prevents any significant shift of current in the adjacent individual cells of the electrolyzers immediately preceding and following the electrolyzer to be bypassed. The jumper switch means 8 is also provided with two switch units 17 and 18 and a resistor means 19. Once the extension arms 12 and 13 have been connected to the anodic and cathodic contact points (11 and 14 in FIGS. 3 to 7), switch unit 17 is closed and part of the total electric current is bypassed through resistor means 19. The remaining minor part of the electrical current still fed to the electrolyzer to be bypassed allows operating conditions to be established in the electrolyzer so that reverse current is prevented on a subsequent short-circuiting sequence. After a suitable time after closing switch unit 17, switch unit 18 is also closed, allowing the complete bypassing of the electrolyzer without any important reverse current crossing the electrolyzer itself.

An alternative electrical circuitry is illustrated in FIG. 9 and in this case, the bus bars have been divided in subunits 20, 21 and 22, 23 respectively, to which the extension arms 12 and 13 are connected respectively. Each subunit which is electrically insulated from the other is provided with switch units (24, 25 and 27, 28 respectively) and resistor means (26, 29) to be operated as described above for the jumper switch means of FIG. 8. Dividing the bus bars into subunits avoids the shift of the electrical current mentioned above, without resorting to the use of massive metal at the cost of some added complexity of the electrical circuitry.

FIG. 10 describes the circuitry of FIG. 9 in the extreme case where each pair of anodic and cathodic extension arms 12, 13 is connected to its own switch unit (30,31) and resistor means (32) in a modular arrangement. When using the parallel arrays of switch units and resistor means described in FIGS. 9 and 10, the switches are to be operated simultaneously (e.g. in FIG. 9: 24 and 27 and then 25 and 28).

FIGS. 11 and 12 illustrate the advantages of using a cart 33 to position the jumper switch means 8. As the jumper switch means 8 is moved into position above electrolyzer 2 which is to be moved out of the line of electrolyzers for service, the supports for the electrolyzers may be low as there is no need for a large space beneath them. Since the jumper switch means is moved by the cart and is positioned over the electrolyzer, there is no need for a fixed overhead crown which results in lower construction costs for a new plant. The cart can also be used in existing plants.

After the cart 33 has been moved into position so that the jumper switch means 8 is in place, a fork lift will set the jumper switch means whereby the supporting means 9 and 10 are in contact with the anodic contact points 11 of the electrolyzer preceding the electrolyzer to be removed and to the cathodic contact points 14 of the electrolyzer immediately following the electrolyzer to be removed, respectively. The jumper switch means 8 is then supported by this connection as in FIG. 5 since supports 9 and 10 are rigid. The by-passed electrolyzer is then removed by the forklift for transportation to the maintenance area for repair.

To properly comprehend the invention, it should be understood that resitivity is the direct current (d.c.) resistance between opposite parallel faces of a portion of the material having a unit length and a unit cross section. The resistivity of a material determines the electrical resistance offered by a material and resistance is calculated according to the formula:

$$R=pL/A \quad (1)$$

where

R=resistance in micro-ohms p=resistivity in micro ohms/centimeter

L=length in cm

A=cross sectional area in cm2

Example of reistivity of several metals are follows:

| METAL | RESISTIVITY (microohm-cm) |
|---|---|
| aluminum | 2.655 |
| copper | 1.673 |
| cast iron | 75–98 |
| lead | 20.65 |
| magnesium | 4.46 |
| nickel | 6.84 |

-continued

| METAL | RESISTIVITY (microohm-cm) |
|---|---|
| steel | 11-45 |

The voltage drop in a bus bar as identified by numerals 6 and 7 in FIGS. 1 and 2 may be calculated for the arrangement of FIG. 1, where a conventional jumper switch means 8 is used to bypass electrolyzer 2, and is given by:

$$V=0.5RI \quad (2)$$

wherein

R is as defined in equation (1) above and

I is the total current flowing through the electrolyzers.

Assuming a total current of 60,000 Amps, the length L equal to 200 cm and the cross sectional area A equal to 100 $cm^2$ the voltage drop V along the bus bar is 0.1 Volt.

It is for this reason that attaching a jumper switch means of the prior art to one end of the bus bar 6 and 7 will cause a shift in current in those cells closest to the jumper switch means contact points as illustrated in FIG. 2. In those cases where the prior art taught the use of a jumper switch means attached to bus bars 6 and 7 as in the U.S. Pat. No. 4,561,949 and U.S. Pat. No. 4,589,966, the electrolyzers were limited to a few monopolar cells to avoid an excessive shift in current flow.

As can be seen, the electrical resistance can be minimized by (1) decreasing the length of the current path or (2) by increasing the thickness of the bus bars. In both cases, the prior art is limited by practical considerations. Therefore, the prior art will always experience some shift in current.

With the jumper switch means of the present invention, current can be transferred uniformly from electrolyzers comprising any number of individual cell units without causing a shift in electrical current. As a matter of fact, the electrical current is directly fed from the individual cells of the electrolyzers through the extension arms into the jumper switch means of the invention without traveling across the bus bars which electrically connect the electrolyzers during normal operation.

In addition, the internal circuitry of the jumper switch means of the invention is designed to allow the portions of the total current which travel along the extension arms to be equal. This result is achieved by using the design alternatives shown in FIGS. 8 or 9 or 10, that is oversized internal bus bars sized to give less than 50 mv ohmic drop, or internal bus bars divided into subunits, each one provided with a switch and resistor means, individual switch and resistor means for each extension arm, this last arrangement allowing, as a further advantage, a better control of the heat generated by the electrical current.

With conventional jumper switch means, the bypassed electrolyzer must be removed by lifting over-the jumper switch means along aside it which results in unsafte conditions for the workers. The electrolyzer is heavy and is above the workers with the possibility of electrolyte which can be 32% caustic and chlorinated brine in chloro-alkali electrolysis leaking down on the workers. The jumper switch means also blocks access to and from the bypassed electrolyzer. By placing the jumper switch means of the invention overhead or beneath the bypassed electrolyzer, these problems are avoided and the electrolyzer may be kept at ground level and removed by a conventional fork-lift truck, for example. There is no risk of the electrolyzer dropping on the workers and access to the electrolyzer is open.

With the jumper switch means of the invention, there is a saving of up to 40% of copper since the bus bars connecting the electrolyzers can be designed just to transfer current between the electrolyzers and not to minimize the shift of electrical curent in the individual cells of the electrolyzers caused by the prior art switch means. Also, in view of the fact that the total current is divided into small portions per each extension arm, the voltage drop along the extension arms is negligible and the connection between each extension arm and the relevant anodic and cathodic contact points may be of the friction type (e.g. the spring-loaded pincers mentioned before) rather than the bolted type required by the prior art jumper switch means where the total high current flows therethrough. The prior art bolting is time consuming .and requires the workers to be between the operating electrolyzers for a longer period of time which is dangeous. Another advantage of the jumper switch means of the invention is that there is no limit to the number of cells in the electrolyzer to be bypassed.

Various modifications of the apparatus and method of the invention may be made without departing from the spirit or scope thereof and it should be understood that the invention is intended to be limited only as defined in the appended claims.

What we claim is:

1. A method for by-passing a monopolar electrolyzer out of a plurality of monopolar electrolyzers connected in series to an electrical power source, which electrolyzers consist of individual electrolysis cells each having anodic and cathodic contact points, by means of a jumper switch means comprising an internal circuitry and a multiplicity of extension arms for connection to the electrolyzers immediately preceding and following the electrolyzer to be by-passed, characterized in that said jumper switch means is positioned on a mobile cart (33) provided with mechanical devices suitable for permitting withdrawal of an electrolyzer out of the plurality of electrolyzers connected in series;

said cart is brought in proximity of the electrolyzer to be by-passed;

said jumper switch means is moved above the plurality of electrolyzers and supported by said multiplicity of extension arms fixed onto the contact points of the two electrolyzers immediately preceding and immediately following the electrolyzer to be by-passed, said multiplicity of extension arms comprising first extension arms connected to the anodic contact point of each individual cell of the electrolyzer immediately preceding the electrolyzer to be by-passed and second extension arms connected to the cathodic contact point of each individual cell of the electrolyzer to be by-passed, said first and second extension arms being joined to said internal circuitry to provide by-passing of the electrolyzer without a shift of electrical current in the adjacent cells of the electrolyzers immediately preceding and immediately following the electrolyzer to be by-passed;

the by-passed electrolyzer is transferred onto said cart and moved to a maintenance area.

2. The method of claim 1 wherein the internal circuitry comprises at least one switch and one resistor means.

3. The method of claim 2 wherein the internal circuitry further comprises a first internal bus bar connecting said first extension arms and wherein said switch and resistor means are provided in common for all extension arms.

4. The method of claims 2 wherein the internal circuitry further comprises first internal bus bars connecting groups of said first extension arms and second internal bus bars connecting corresponding groups of said second extension arms and wherein separate switch and resistor means are provided for each said group of extension arms.

* * * * *